United States Patent [19]

Ching

[11] Patent Number: 4,955,577

[45] Date of Patent: Sep. 11, 1990

[54] REMOVABLE MOUNTING ASSEMBLY FOR FOG LIGHTS AND FLAG POLES

[76] Inventor: Daw-Long Ching, No. 4-1, Lane 68, Chen Kung Road, Tainan City, Taiwan

[21] Appl. No.: 363,739

[22] Filed: Jun. 9, 1989

[51] Int. Cl.[5] ..... H01Q 1/12

[52] U.S. Cl. ..... 248/539; 24/635; 362/82

[58] Field of Search ..... 248/539, 503, 220.2, 248/27.1, 27.3, 251; 24/635, 632, 633; 280/762; 296/1.1; 40/591; 362/82, 249, 382

[56] References Cited

U.S. PATENT DOCUMENTS

| | | | |
|---|---|---|---|
| 2,143,997 | 1/1939 | Parkinson | 362/82 X |
| 2,277,172 | 3/1942 | Vacher | 24/635 |
| 2,726,836 | 12/1955 | Dickson | 362/82 X |
| 3,043,614 | 7/1962 | Eichmann | 24/635 X |
| 3,487,359 | 12/1969 | McClintock | 362/82 X |
| 3,590,236 | 6/1971 | Ussery | 362/82 |
| 4,149,694 | 6/1978 | Verini | 248/539 |
| 4,198,080 | 4/1980 | Carpenter | 24/635 X |
| 4,347,556 | 8/1982 | Malm | 362/382 |
| 4,791,535 | 12/1988 | Sclafani et al. | 362/249 |

FOREIGN PATENT DOCUMENTS

| | | | |
|---|---|---|---|
| 2576854 | 2/1985 | France | 362/82 |

*Primary Examiner*—David L. Talbott
*Assistant Examiner*—Daniel Hulseberg
*Attorney, Agent, or Firm*—Browdy & Neimark

[57] ABSTRACT

The present disclosure is related to detachable mounting assembly adapted for location of fog lights and flag poles having light element disposed at the top end thereof, which is removably secured under the front bumper. To better protect the fog lights and flag poles from being stolen or sabotaged, the driver can remove the lights and poles and fix them in place in the rear trunk when the automobile is parked for a long period of time.

2 Claims, 5 Drawing Sheets

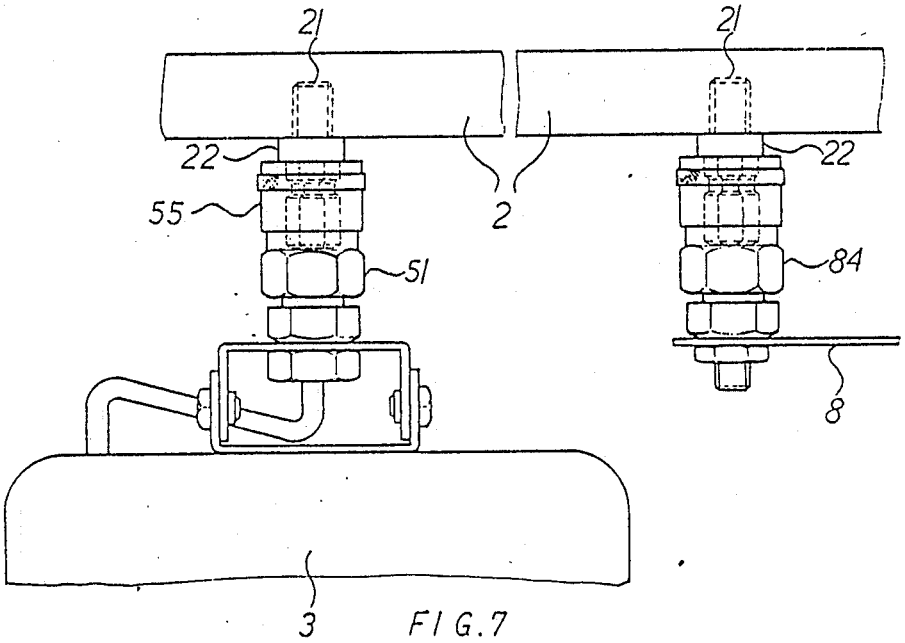
FIG.7
FIG.8
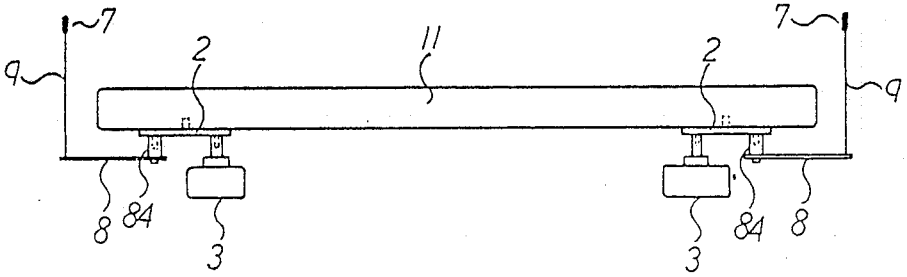

REMOVABLE MOUNTING ASSEMBLY FOR FOG LIGHTS AND FLAG POLES

FIELD OF THE INVENTION

The present invention relates to a detachable mounting assembly adapted for securing a number of fog lights and flag poles to the front bumper of an automobile and the lights and poles can be removed and located in place in the trunk of the automobile so that stealing and sabotage of the fog lights and flag poles can be effectively prevented.

Generally speaking, fog lights enable a driver to see farther distance when driving in a bad weather or foggy areas, and are conventionally fixed on the front bumper of an automobile. However, it is unavoidable that the lights are easily weather beaten or sabotaged by accidents and even stolen by some people.

It is often seen that flag poles are disposed on the two sides of the bumper and they can be of help to some drivers to estimate the distance in driving in a narrow street; therefore it can help to increase the driving safety of automobiles beside it normal use.

The present inventor has noticed the disadvantages with the prior way of mounting the fog lights and flag poles and worked out a mounting assembly which permits the lights and poles to be detachably mounted together to the front bumper of an automobile so as to eliminate the above said disadvantages.

SUMMARY OF THE INVENTION

Therefore, the primary object of the present invention is to provide a mounting assembly which is easily mounted and dismounted under the front bumper of an automobile with a pair of fog lights and flag poles secured thereon. When the automobile is parked in place, the driver can take down the lights and poles and fix them at position in the trunk of the automobile so as to prevent the same from being stolen or sabotaged by other people.

To better illustrate the structure and operation modes and features of the present invention, a number of drawings are shown along with a detailed description of the preferred embodiment of the present invention, in which:

BRIEF DESCRIPTION OF THE DRAWINGS

FIG. 7 is a diagram showing the mounting of a fog light and a pole to the mounting device; and FIG. 8 is a diagram showing the practical application of the present invention to a bumper.

DETAILED DESCRIPTION OF PREFERRED EMBODIMENT

Figure 1:
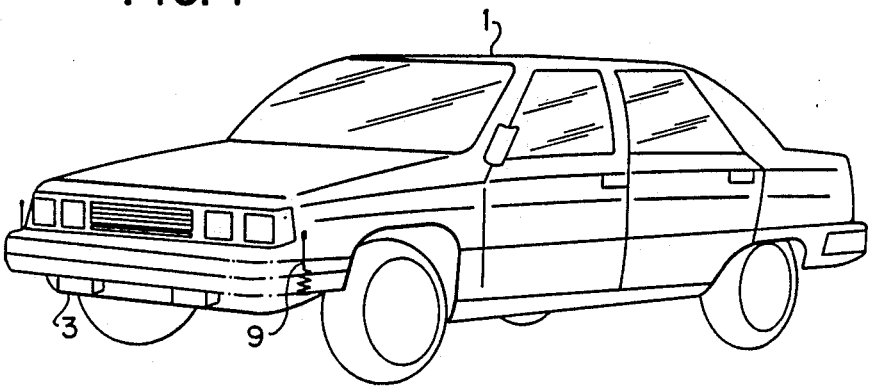
FIG. 1 is a diagram showing the application of the present invention to an automobile.
Figure 2:
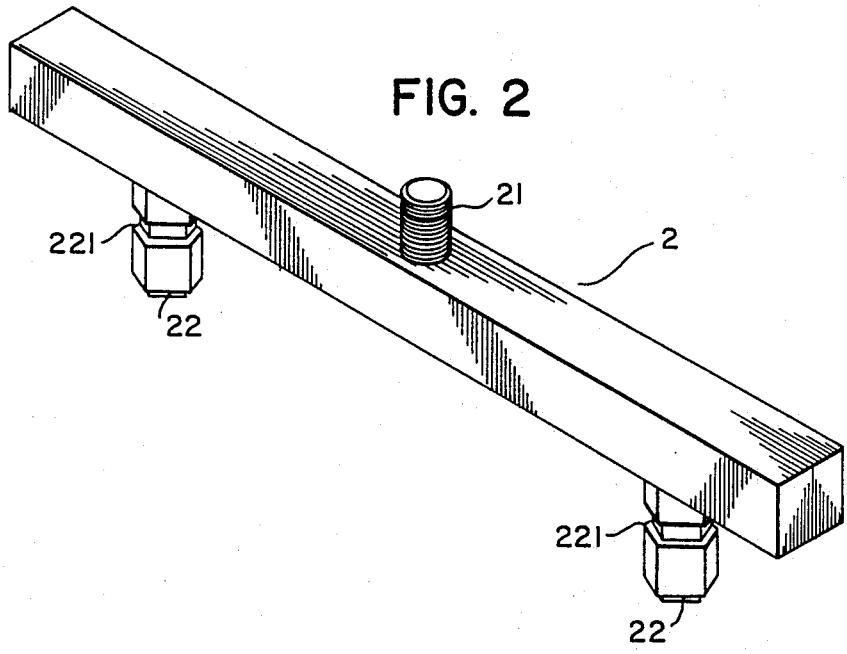
FIG. 2 is a perspective view of the mounting device of the invention.

Referring to FIGS. 1, 2, a mounting device 2 is removably secured under the front bumper 11 of an automobile 1, at each end thereof. The mounting device 2 having a screw-like protrusion 21 disposed on the top surface thereof is equipped with a pair of base elements 22 for location of fog lights 3 and flag poles 9; each of the base elements 22 is provided with an engagement groove 221 at the middle thereof, and one end thereof is defined to have an octagon form and the other is provided with a plurality of threads 222.

Figure 3:
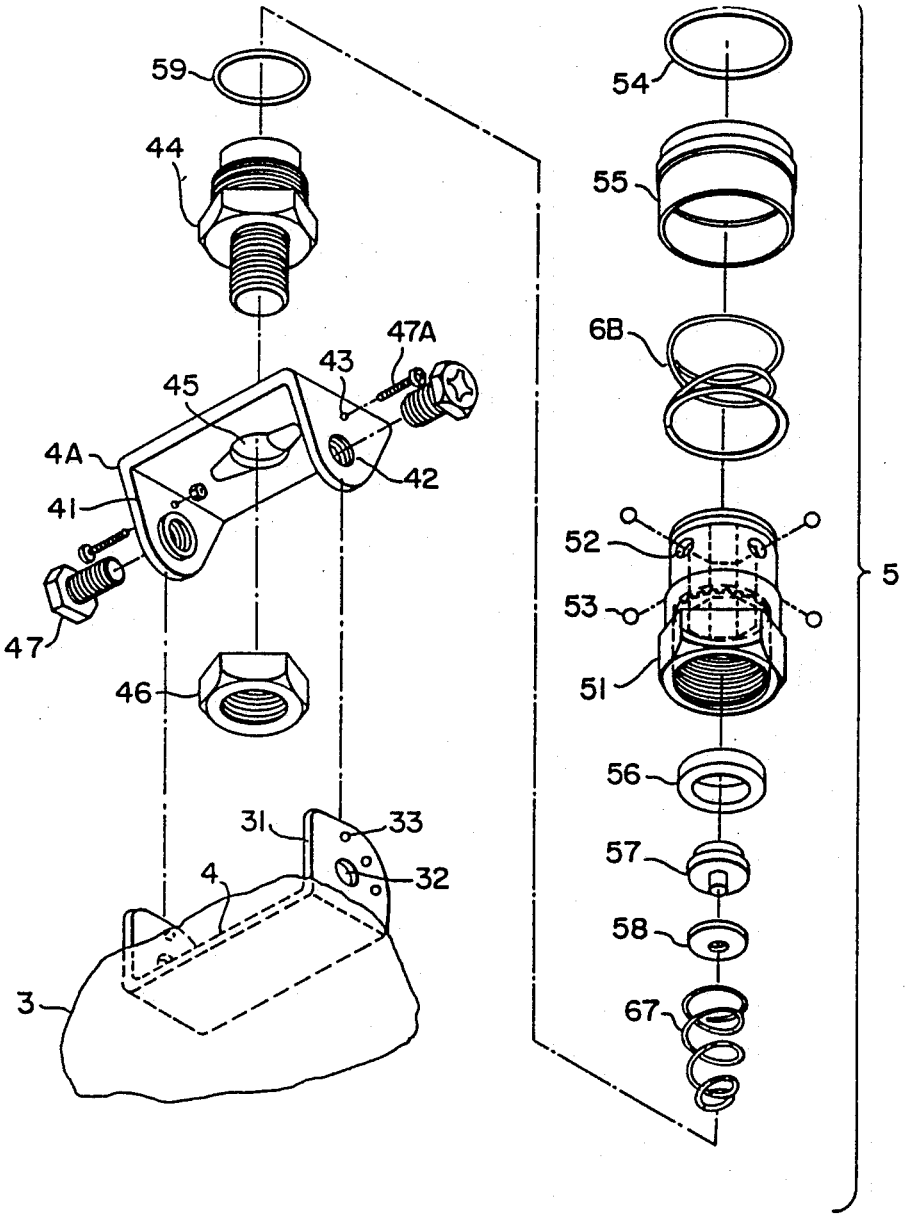
FIG. 3 is a perspective view showing the exploded components of the securing assembly and the fixing means under a fog light.
Figure 4A:
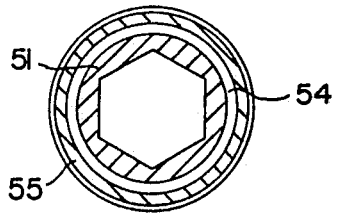
FIGS. 4A and 4B are diagrams showing the top cross sectional view and a transverse sectional view of the securing assembly, respectively.
Figure 4B:
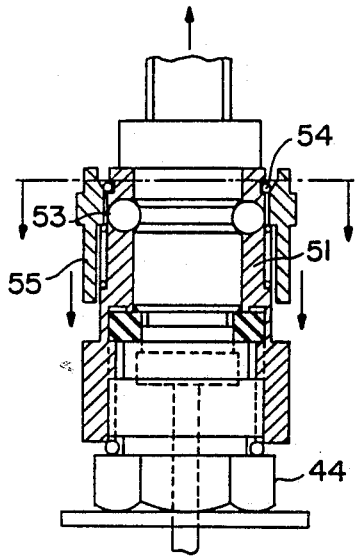
Figure 5:
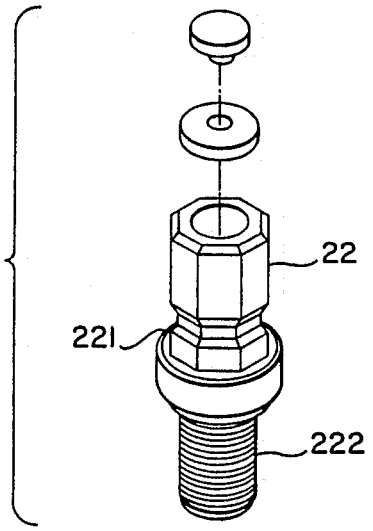
FIG. 5 is a diagram showing the structure of a base element.

As shown in FIGS. 3 and 5 to the underside of each fog light 3 is secured a C-shaped first mounting member 4 having a pair of oppositely disposed lugs 31 at the center of each of which is provided with a through hole 32 with a number of pores 33 disposed adjacent thereto. A second C-shaped mounting member 4A is pivotally engaged with the first mounting member 4 on each lug of which is furnished with a through threaded hole 42 and an aperature 43. A pair of bolts 47 and screws 47A are used to couple the first and second mounting members 4, 4A together by putting the bolts and screws through the corresponding holes 42, 32 and 43, 33. The fog lights 3 can be tilted to a number of selective angles by engaging the aperature 43 of the second mounting member 4A with one of the pores 33 of the first mounting member 4. At the center of the horizontal board of the second mounting member 4A is disposed a central through hole 45. A double ended bolt 44 is guided through the central hole 45 and secured in place by a nut 46.

The fog lights are mounted to the mounting device by way of the base element 22 and a securing assembly 5 which includes an elongated nut member 51 having four symmetric bores 52 disposed at the bottom thereof each with a steel ball 53 movably placed therein respectively. A first spring 6A is located inside the nut member 51. A C-shaped clip member 54 is attached to the bottom periphery of the nut member 51 with a second spring 6B surrounding the external wall thereof so that a tubular cover 55 can be secured in place to the nut member 51 with the lower edges of the nut member as well as the tubular cover 55 lying flush with each other. Thus, the steel balls are operatively confined in place.

Inside the nut member 51 are located a washer 56, a fixing element 57, a ring member 58 and the first spring 6A in a consecutive order, and the nut member is engaged with the lower end of the double-ended bolt 44, as shown in FIG. 3.

Referring to FIG. 5, the threaded portion 222 of the base element 22 is engaged with the threaded bottom hole at the underside of the mounting device 2. The top end of the base element 22 is defined in an octagon form with a hole disposed at the central portion thereof. When the base element 22 is inserted into the nut member 51, having its internal wall defined in correspondence with the octagon-shaped top end of the base element 22, the tubular cover 55 is pushed upward to make the steel balls 53 moved radially inward and engaged with the engagement groove 221 so as to fix the securing assembly 5 in place. Thereby, the fog light 3 is vertically secured under the front bumper 11 of the automobile 1.

Figure 6:
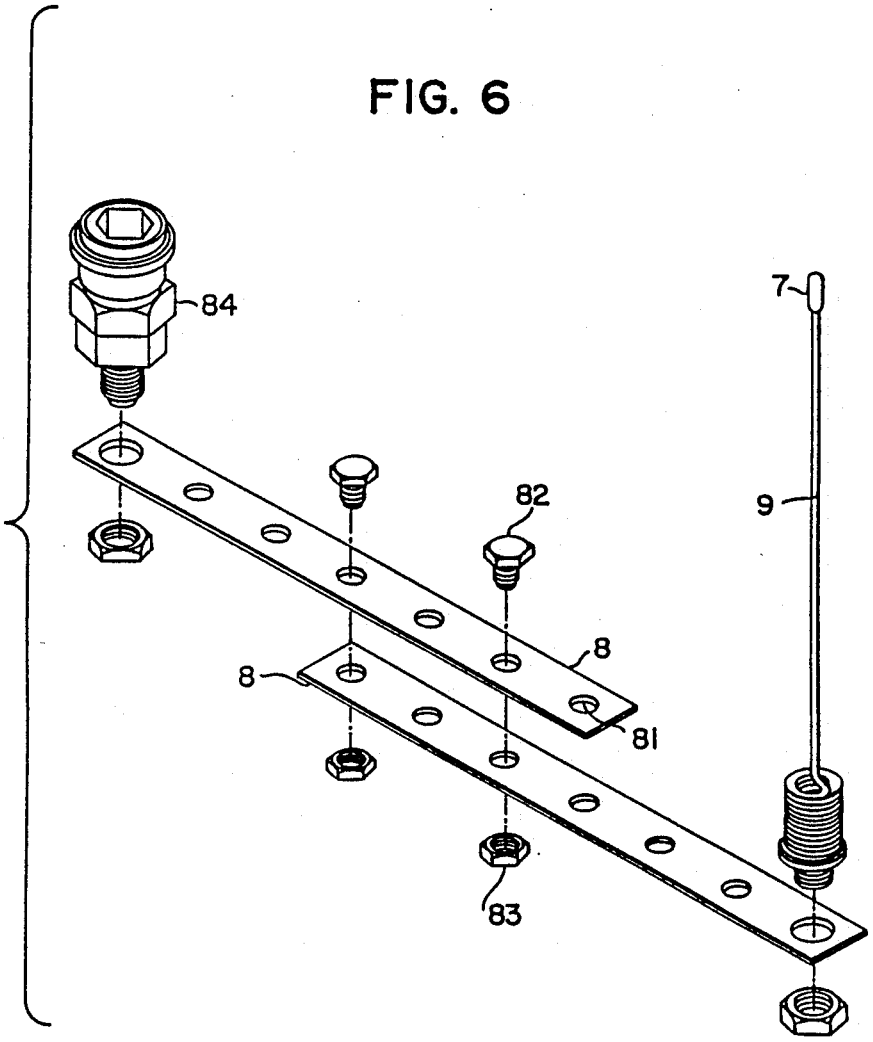
FIG. 6 is a diagram showing the exploded components of the flag pole fixing means.

As shown in FIG. 6, the flag pole 9 having a light element 7 disposed at the top end thereof is fixed in place by a pair of oblong boards 8 provided with a plurality of spaced bores 81. The boards are partially Joined together by bolts and nuts 82, 83, and a coupling seat 84 having the same structure as that of said securing assembly 5 is detachably fixed at one end of the assembled oblong boards 8 and is further engaged with one of the base element 22 secured under the mounting device 2, as shown in FIG. 7.

Referring to FIGS. 7, 8, the application of the present invention to the automobile 1 is clearly shown. Under the front bumper 11 are secured a pair of mounting devices 2. Each of the mounting device 2 is provided with a couple of base elements 22 disposed at the ends of the same, permitting respectively the attachment of the securing assembly 5 for the fog light 3 and the coupling seat 84 of the boards 8 on which the flag pole 9 is mounted. Thus, the fog lights 3 are able to be secured symmetrically under the bumper and the flag poles 9 with light elements 7 can be located at both sides thereof.

As a result of the easy detachment of the securing assembly 5 and the coupling seat 84 from the base elements 22, the fog lights 3 and the flag poles 9 are able to be dismounted from the bumper 11 and secured in place in the rear trunk by the driver so that stealing and sabotage of the same can be prevented.

I claim:

1. A detachable mounting assembly adapted for the location of a fog light and a flag pole having a light element disposed at the top end thereof, under the front bumper of an automobile, comprising:

a mounting device screwed under the bumper by means of a screw-like protrusion disposed on the top surface thereof;

a pair of base elements each of which is provided with a threaded end so as to permit the same to be secured under said mounting device, the other end thereof being defined in an octagon shape with a hole disposed at the center thereof and a peripheral engagement groove being provided about the central exterior portion thereof;

a fog light having a first C-shaped mounting member fixed under the bottom thereof, which is provided with a pair of lugs; on each of the lug being disposed a central hole with a number of pores located adjacent to it;

a second C-shaped mounting member provided with a horizontal board and a pair of depending lugs having a central through hole disposed on the horizontal board thereof and the lugs thereof being provided with holes in correspondence with the central holes disposed on the lugs of said first mounting member so that the second mounting member can be pivotally engaged with said first mounting member by bolts and screws;

a double ended bolt with one threaded end thereof going through the central hole of said second mounting member and locked in place by a nut means;

a securing assembly including an elongate nut member the interior of the bottom end of which is defined in an octagon form and the top end thereof provided with internal threads, into which a washer, a fixing element, a ring member and a first spring are placed; and the other threaded end of said double ended bolt being engaged with the top threaded end of said elongate nut member in assembly; the lower end of said elongate nut member being provided with 4 symmetric bores in each of which a steel ball is movably disposed, and a second spring being disposed in encircling relation with the lower end of said nut member; and a tubular cover being slidably attached to the lower end of said elongate nut member with said second spring disposed between the cover and said nut member; a C-shaped clip member being employed to support said tubular cover in place;

whereby the actuation of said tubular cover in one direction will permit said steel balls to move radially outward so as to enable said octagon-shaped end of said base element inserted into the correspondingly-shaped bottom end of said elongate nut member which is associated with a fog light, and the movement of said tubular cover in the opposite direction will force said steel balls to slide in a reverse direction and to engage with the peripheral engagement groove of said base element so that a fog light can be removably secured to said mounting device attached to the underside of the bumper of an automobile.

2. A detachable mounting assembly as claimed in claim 1 wherein the flag poles with a light element disposed at the top end thereof is removably secured to said mounting device by means of:

a pair of oblong boards having a plurality of through holes disposed thereon and detachably joined together by fixing means;

a coupling seat having a threaded end which is screwed to one hole of said oblong board, and the other end being provided with a hole having an octagon-shaped opening so that the coupling seat can be engaged with the corresponding end of said base element in the same way as that of said securing assembly and locked in place;

a flag pole having a light element disposed at the top end thereof and detachably secured to said oblong board in assembly.

* * * * *